United States Patent [19]

Shinohara et al.

[11] Patent Number: 4,602,921

[45] Date of Patent: Jul. 29, 1986

[54] AIR CLEANER

[75] Inventors: Shinichi Shinohara; Kenyo Matsushita; Takao Nishizaki, all of Shizuoka, Japan

[73] Assignee: Nippon Light Metal Company Limited, Tokyo, Japan

[21] Appl. No.: 693,892

[22] Filed: Jan. 23, 1985

[30] Foreign Application Priority Data

| | | | |
|---|---|---|---|
| Jan. 24, 1984 | [JP] | Japan | 59-7940[U] |
| Mar. 14, 1984 | [JP] | Japan | 59-36458[U] |
| Jun. 9, 1984 | [JP] | Japan | 59-85725[U] |
| Jun. 9, 1984 | [JP] | Japan | 59-85726[U] |
| Jun. 9, 1984 | [JP] | Japan | 59-85727[U] |

[51] Int. Cl.[4] ..... B03C 3/12

[52] U.S. Cl. ..... 55/126; 55/138; 55/139; 55/145; 55/152; 55/154; 361/230

[58] Field of Search ..... 55/124, 136–138, 55/139, 150–153, 145, 143; 361/229, 230

[56] References Cited

U.S. PATENT DOCUMENTS

| | | | |
|---|---|---|---|
| 2,798,572 | 7/1957 | Fields | 55/137 |
| 3,551,743 | 12/1970 | Elgin et al. | 55/152 |
| 3,988,131 | 10/1976 | Kanazawa et al. | 55/138 |
| 4,516,991 | 5/1985 | Kawashima | 55/124 |
| 4,523,082 | 6/1985 | Sturdevant | 361/229 |

FOREIGN PATENT DOCUMENTS

| | | | |
|---|---|---|---|
| 1023012 | 1/1958 | Fed. Rep. of Germany | 55/150 |
| 1101372 | 3/1961 | Fed. Rep. of Germany | 55/152 |
| 968982 | 9/1964 | United Kingdom | 55/152 |

*Primary Examiner*—Bernard Nozick

*Attorney, Agent, or Firm*—William J. Daniel

[57] ABSTRACT

Herein disclosed is an air cleaner comprising: means defining an air passage, a plurality of corona discharge electrodes and a coupling discharge electrode arranged upstream of an air passage, being connected to a high voltage source for effecting a corona discharge downstream of the air passage for collecting the air-borne dust which has been charged by the corona discharge. The coupling discharge electrode is formed as a plate with a number of circular apertures therein, and each of the discharge electrodes has a multiplicity of leading ends shaped as sharp points arranged at the respective centers of the circular apertures and terminating generally on the plane thereof. The velocity of the air flow is increased in passage through the apertures to prevent the air cleaner from getting clogged. The corona discharge electrodes take the form of metal plates or bars extending generally rigidly across the air passage and mounted to the air cleaner at their ends, the sharp points being integral with the plates or bars and projecting therefrom toward the coupling electrode apertures.

15 Claims, 15 Drawing Figures

AIR CLEANER

BACKGROUND OF THE INVENTION

Field of the Invention

The present invention relates to an air cleaner for cleaning contaminated air by charging the dust floating in the air of an air passage with ions generated by a corona discharge to collect it by a dust collecting electrode and, more particularly, to an air cleaner which is enabled to have its dust collecting efficiency improved by making the corona discharge uniform and in which a discharge unit for the corona discharge is caused to get less clogged.

SUMMARY OF THE INVENTION

An object of the present invention is to provide an air cleaner which is enabled to effectively solve all the above-specified defects.

The air cleaner according to the present invention is characterized in that a coupling discharge electrode is made of a metallic plate having numerous holes to increase the flow velocity of air therethrough so that it may be prevented from getting clogged, and in that a discharge electrode is arranged at the respective centres of the holes of the coupling electrode.

DESCRIPTION OF THE PRIOR ART

Figure 1:
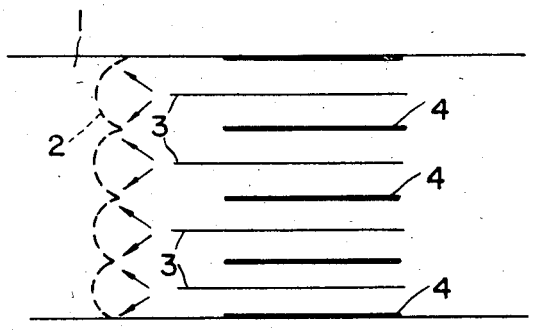
FIGS. 1 and 2 are schematic sections for explaining the examples of the prior art.
Figure 2:
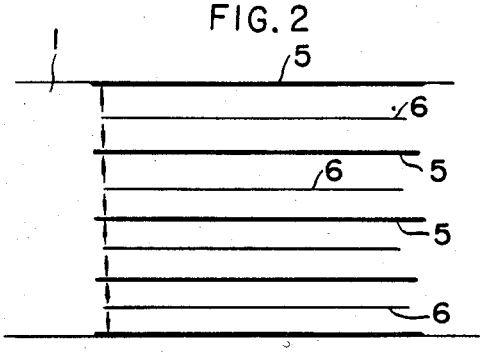

In a common house, an office, a gaming room, a chamber of the vehicle such as an automobile or a factory, an air cleaner is used for cleaning the surrounding air in the facilities. FIGS. 1 and 2 show examples of the air cleaner according to the prior art. In the air cleaner shown in FIG. 1, a coupling discharge electrode 2 made of a netted member is arranged in an air passage 1 at a right angle with respect to the air flow, and plate-shaped discharge and dust collecting electrodes 3 and 4 are arranged downstream of the passage 1 alterately of each other and in parallel with the air flow. In the air cleaner of FIG. 2, on the other hand, needle-shaped discharge electrodes 6 are arranged in cylindrical plates 5 in which a coupling discharge electrode and dust collecting electrodes are integrated. However, the air cleaner of FIG. 1 has a defect that the meshes of the coupling discharge electrode 2 catch the dust to get clogged. On the other hand, the air cleaner of FIG. 2 has defects: that the dust collecting plates 5 are made of an assembly of cylinders and are difficult to be aligned with the discharge electrodes 6 so that charging irregularities are caused to degrade the dust collecting efficiency; and that the cylinder assembly has its effective area made so smaller than that of the air passage that it gets clogged when it is operated in the state of the irregular charge although it has a high air flow velocity.

Moreover, the prior art has found it difficult to position and align the discharge electrodes. Stillmoreover, the discharge electrodes themselves are weak, and their replacements are troublesome. Furthermore, it is inconvenient to mount or demount the dust collecting electrodes having caught the dust. As the case may be, the deodorizing effect has been insufficient.

DESCRIPTION OF THE PREFERRED EMBODIMENTS

FIGS. 3 to 7 are perspective views showing the whole structure of one embodiment of and sectional views showing the principles of the present invention. In a box-shaped casing 10, there is formed an air passage 11 in which air flows in a direction of arrow A. Upstream of this air passage 11, there are arranged a prefilter 12 made of a netted member and a discharge 20 for conducting a corona discharge. Downstream of the air passage 11, on the other hand, there are arranged a dust collector 30 for attracting and removing dust and a deodorizing filter 13. The aforementioned casing 10 can be either placed on a floor or hung from a wall or the like and has its upper end face formed with a suction port 16 and its lower portion formed with a discharge port 14. By turning a fan (although not shown) such as a scirocco fan connected to a fan driver 15, the ambient air is caused to flow from the suction port 16 into the air passage 11 and is blown out from the discharge port 14.

Figure 4:
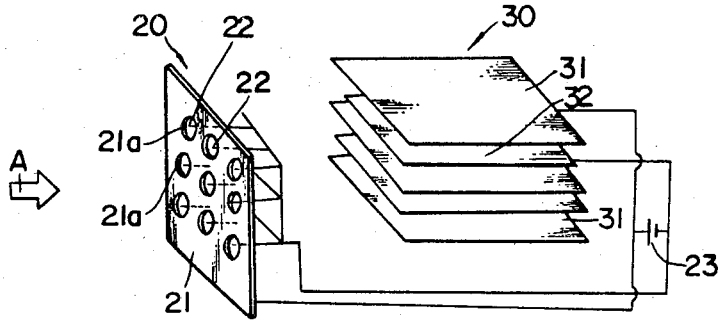
FIG. 4 is a perspective view of FIG. 3.
Figure 3:
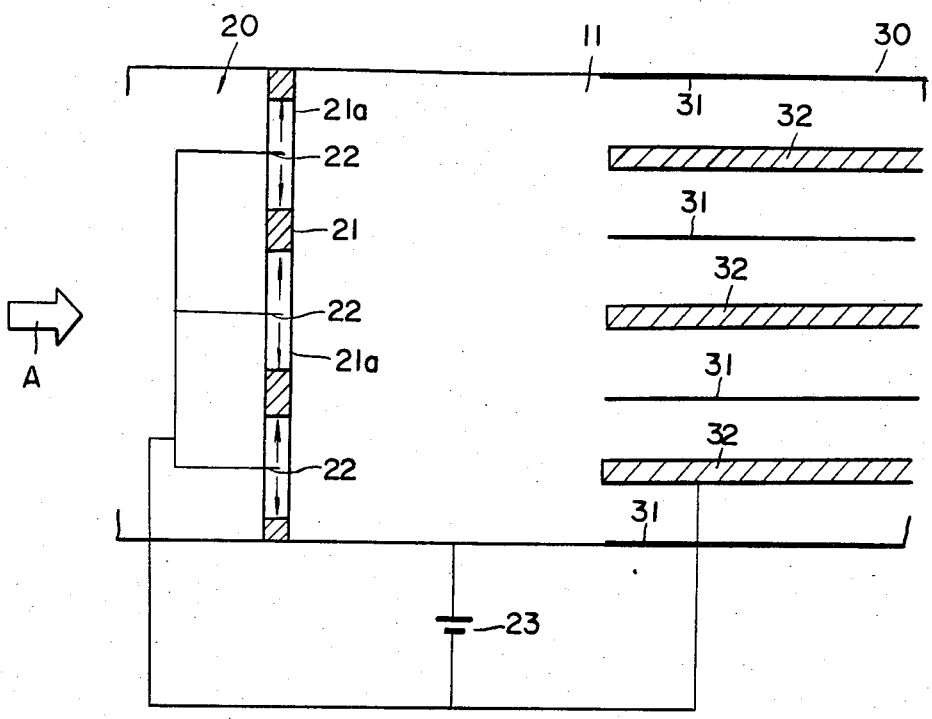
FIG. 3 is a schematic section for explaining the principle of the present invention.
Figure 7:
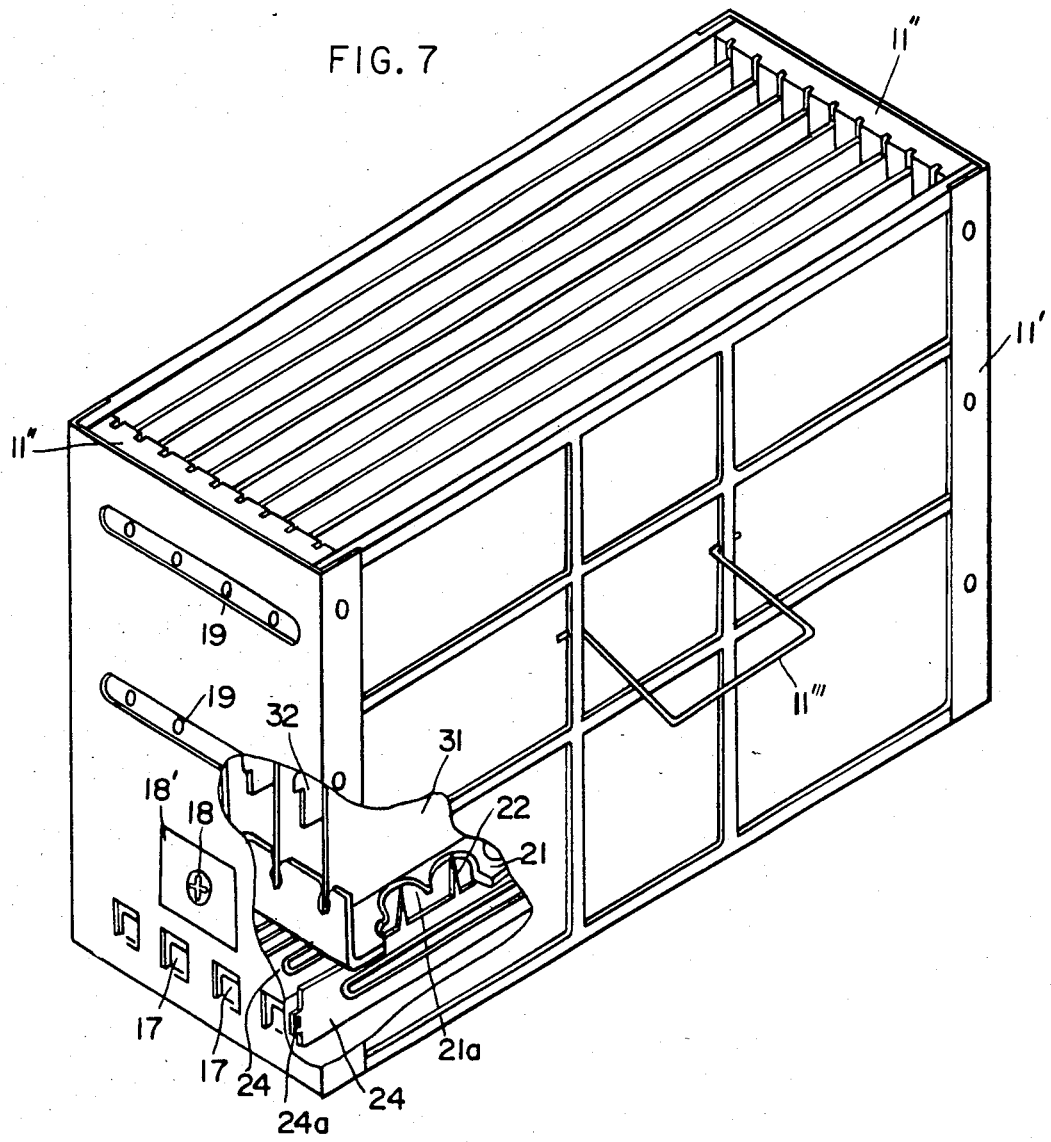
FIG. 7 is a partially cut-away perspective view showing the whole structure of FIG. 6, as viewed from the back.
Figure 13:
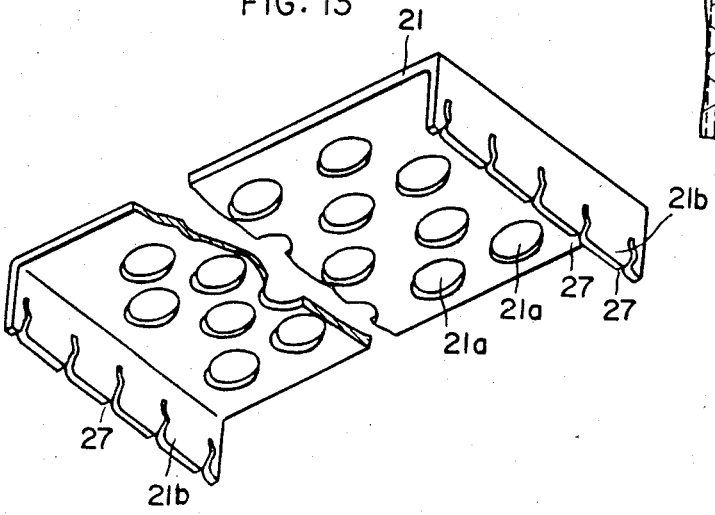
FIG. 13 is a perspective view showing a coupling discharge electrode.
Figure 9:
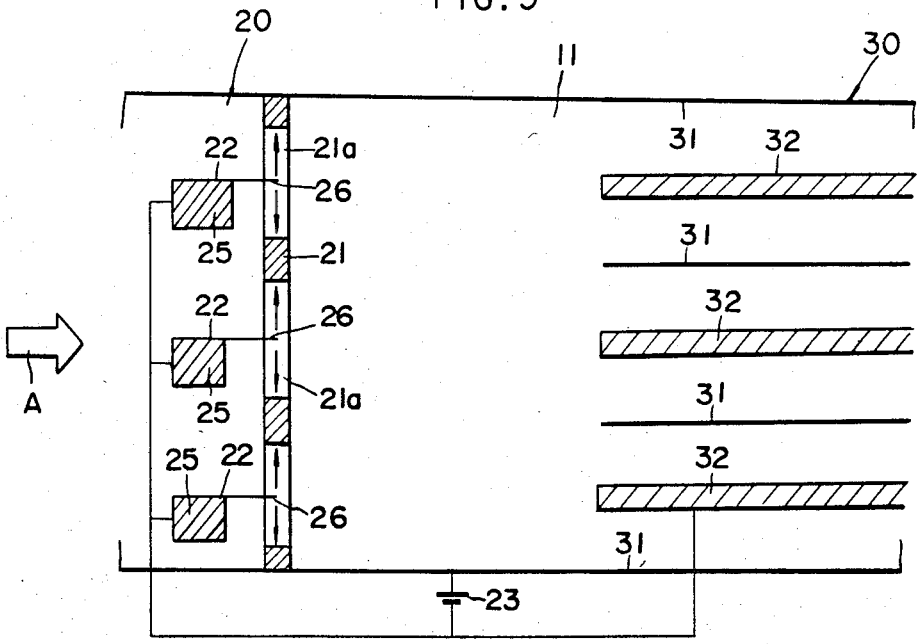
FIG. 9 is an explanatory view showing the case in which another embodiment of the discharge electrode is used.

The aforementioned discharger 20 is constructed of a coupling discharge electrode 21 and a discharge electrode 22, between which the corona discharge is conducted. The discharge electrode 22 is made, as shown in FIG. 4, of a widthwise enlarged discharge plate 24 having its lower end edge formed integrally with a plurality of sharpened tips which protrude at a suitable spacing toward the coupling discharge electrode 21. That discharge electrode 22 is made of a conductive plate having a sufficient strength such as a plate of stainless steel, common steel, copper or brass having a thickness of 0.1 to 1.0 mm, preferably, 0.2 to 0.5 mm, and is prepared to have those sharp tips by pressing that plate. In this case, the discharge plate 22 can be shaped by the pressing work only if the plate thickness is about 1.0 mm. If the thickness exceeds 1 mm, it is necessary to improve the discharging effect by cutting the pressed tips. Moreover, that discharge plate 24 has both its end portions formed with raised tongues **24*a* at which it is held in a dust collecting unit 11' built in the aforementioned casing 10, as shown in FIG. 7. The discharge plate 24 is electrically connected with a power supply 23 by having its end portions engaged with power supply connectors 17 which are formed at both the sides. The power supply may be alternatively used by converting the domestic A.C. power supply of 100 V into a high-voltage D.C. power supply of 4.5–5 KV and 0.1–1 mA by a transformer. Moreover, the discharge plate 24 has its central portion formed with a slot 24***b* which extends in the longitudinal direction thereof and which in turn is formed with a reinforcing rib 24 along its peripheral edge. A plurality of the discharge plates 24 thus prepared are so mounted to have their aforementioned raised tongues 24*a* connected with the power supply connectors 17 that they are arrayed in parallel with the air passage 11. The aforementioned discharge electrodes 22 are positioned at the centres of circular holes 21*a* which are formed in the coupling discharge electrode 21. As shown in FIG. 13, more specifically, the coupling discharge electrode 21 is made of a metal plate of an aluminum, copper or stainless alloy having a thickness of 0.5 to 5 mm, which is formed with the numerous circular holes 21*a*, 21*a* and so on. These circular holes 21*a* can have their diameter suitably changed depending upon the discharging efficiency or the velocity of the air flow but may be commonly 20 to 40 mm. That metal plate is mounted in the air passage 11 at a right angle with respect to the same, and the aforementioned discharge electrodes 22 are positioned at the centres of the respective circular holes 21*a* of that coupling discharge electrode 21. This positioning at the centres of the circular holes makes uniform the corona discharge between the discharge electrode 22 and the coupling discharge electrode 21 thereby to eliminate the discharging irregularities. On the other hand, the total effective area of the circular holes 21*a* is smaller than the effective area of the air passage so that the air flow through the circular holes 21*a* takes a velocity sufficient for preventing the circular holes 21*a* from getting clogged.

Now, the discharge electrode 22 can be also constructed as will be described with reference to FIGS. 9 to 12.

Figure 10:
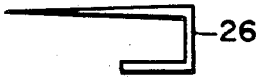
FIG. 10 is a side view showing one of the discharge needles of the discharge electrode according to still another embodiment.
Figure 12:
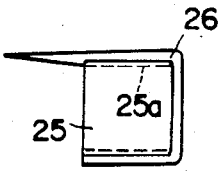
FIG. 12 is a side view showing the state in which the discharge needles and the holder are assembled.
Figure 11:
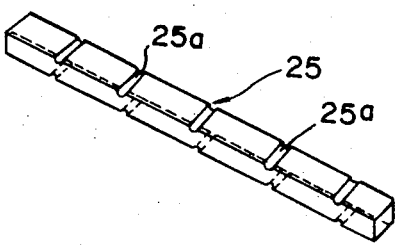
FIG. 11 is a perspective view showing a holder for holding the discharge needles of FIG. 10.

In the embodiment of FIGS. 9 to 12, more specifically, the aforementioned discharge electrode 22 is constructed of: discharge needles 26, 26 and so on which have their leading ends protruding into the centers of the respective circular holes 21*a*, 21*a* and so on of the coupling discharge electrode 21; and holders 25, 25 and so on which hold those discharge needles 26, 26 and so on. Each of these discharge needles 26 is bent generally into the form of letter "C", as shown in FIG. 10. On the other hand, each of the holders 25 is made, as shown in FIG. 11, of an elongated rectangular bar which has both its sides formed with a plurality of engaging grooves 25*a*, 25*a* and so on at a suitable spacing. These engaging grooves 25*a*, 25*a* and so on are formed to fit and fix the aforementioned discharge needles 26 therein. In order to ensure these fitting actions, the widths or gaps of the discharge needles 26 are made slightly smaller than the thickness of the holder 25 so that the discharge needles 26 are held in the holder 25 by their own elasticities in their mounted states shown in FIG. 12. Moreover, the holders 25 have both their end portions protruding out of the passage 11 and suitably fixed on the frame of the air cleaner so that the discharge needles 26 have their leading ends positioned at the centers of the circular holes 21*a* of the aforementioned coupling discharge electrode 21 merely by fitting the discharge needles 26 in those holders 25.

Figure 8A:
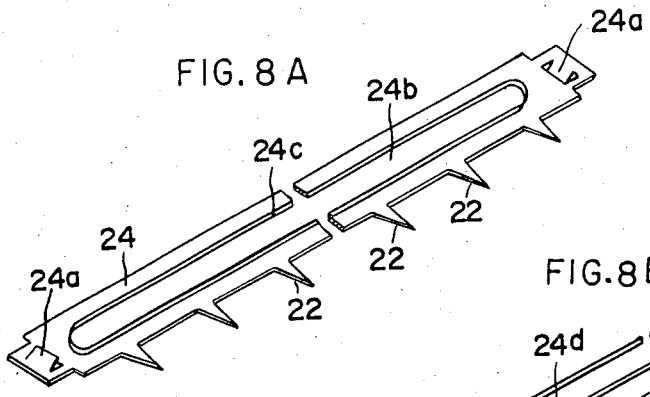
FIGS. 8A and 8B are perspective views showing an embodiment of a discharge electrode.
Figure 8B:
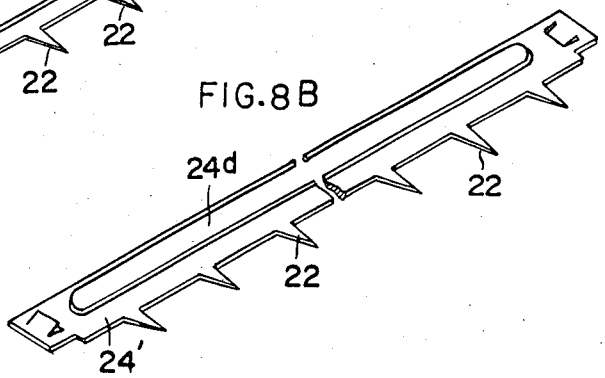

Next, the aforementioned coupling discharge electrode 21 has both its end portions bent generally at a right angle downward, i.e., downstream of the air passage to form bent edges 21*b* which in turn have their lower ends formed with a plurality of parallel mounting grooves 27, 27 and so on. These mounting grooves 27, 27 and so on are used to fit therein dust collecting electrodes 31 which will be described hereinafter. On the other hand, FIG. 8B is a perspective view showing still another embodiment of the discharge plate which is indicated at 24'. A reinforcing plate 24*d* of stainless steel is spot-welded to that discharge plate 24' such that it extends in the longitudinal direction of the central portion thereof.

Figure 5:
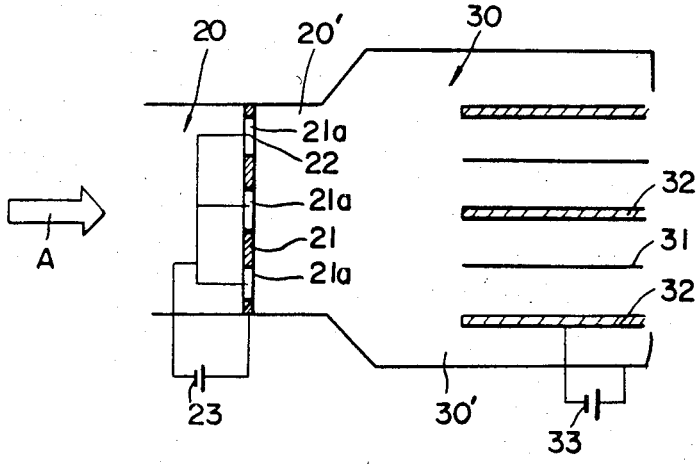
FIG. 5 is similar to FIG. 3 but shows another aspect of the principle of the present invention.

On the other hand, the present invention can be constructed, as shown in FIG. 5. In FIG. 5, more specifically, an upstream air passage 20' arranged with the discharger 20 is intended to have a smaller effective area than that of a downstream air passage 30' arranged with the dust collector 30 so that the air sucked flows at a higher velocity through the upstream passage 20' to effectively restrain the discharger 20 from getting clogged but at a lower velocity through the downstream passage 30' to improve the dust collecting efficiency. Incidentally, reference numeral 33 indicates a power supply which is connected with the respective dust collecting electrodes 31 and dust-collecting coupling electrodes 32 to establish an electric field inbetween.

Figure 14:
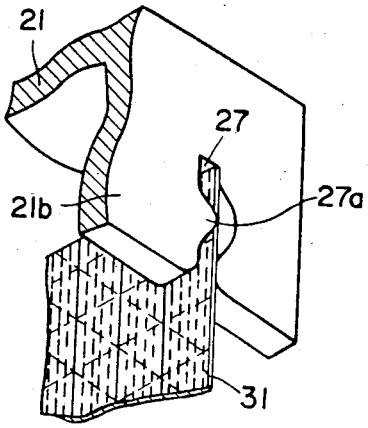
FIG. 14 is an enlarged perspective view showing a portion of a dust collecting electrode in a mounted state.

Next, the aforementioned dust collector 30 is arranged downstream of the discharger 20 thus formed to attract and remove the charged dust. As a result, the dust collector 30 has the plate-shaped dust collecting electrodes 31 and the plate-shaped dust-collecting coupling electrodes 32 positioned alternatively such that they are arranged in parallel with the air flow through the air passage 11. With the power supply 23, moreover, there are connected the dust collecting electrodes 31 and the dust-collecting coupling electrodes 32, between which electric fields are generated to electrostatically attract the charged dust to the dust collecting electrodes 31 thereby to clean the air. Here, each of the aforementioned dust collecting electrodes 31 may be made of a metal plate but may be prepared by laminating aluminum foils on both the sides of a base plate of paper or by coating both the sides of the paper base plate with carbon. In short, the dust collecting electrode 31 may be made of a material having conductive surfaces. Moreover, a polyethylene film may be sandwiched between the base plate and the aluminum foils or the carbon coatings. This use of the paper base plate results in an effect that the dust collecting electrodes can be economically replaced by new ones in case their surfaces are contaminated with the dust. Those dust collecting electrodes 31 are removably attached by having both their end portions fitted in the mounting grooves 27 of the aforementioned coupling discharge electrode 21. As shown in FIG. 14, however, those mounting grooves 27 have their central portions curved generally in the form of letter "C" to form curved portions, which bite into the dust collecting electrode 21 fitted in the mounting grooves 27 so that the dust collecting electrodes 31 are fitted reliably and easily. As a result, the dust collecting electrodes 31 can be replaced by new ones without any difficulty because they can be mounted requiring neither any screw nor any welding work and can be removed simply. For these fitting relationships, the mounting grooves may be molded to have another form such as corrugations. In FIG. 7: reference numeral 18 indicates a power supply connector for the coupling discharge electrode 21; numeral 19 indicates power supply connectors of the dust-collecting coupling electrodes 32 which are arranged in parallel with the dust collecting electrodes 31; and numeral 18' indicate an insulator for the former (and the dust collecting electrodes 31). Moreover, the dust collecting electrodes 31 and their coupling electrodes 32 are mounted by making use of guides 11'' and 11'' of an insulating material, which are mounted on the dust collecting unit 11'.

Further downstream of such dust collector 30, there is disposed the deodorizing filter 13 for deodorizing the air, which is arranged at a right angle with respect to the air passage. That deodorizing filter 13 is charged with activated charcoal having an excellent deodorizing action to effect deodorization. This deodorizing agent need not be limited to the activated charcoal but may be an adsorbent of divalent iron ions or may be a mixture of the former two. In this case, the adsorbent of divalent iron ions may be exemplified by adding a small quantity of L-ascorbic acid to the divalent iron ions. This absorbent suppresses oxidization of the divalent iron ions into the oxygen in the air through reduction of the L-ascorbic acid so that its deodorization is maintained for a long time.

Figure 6:
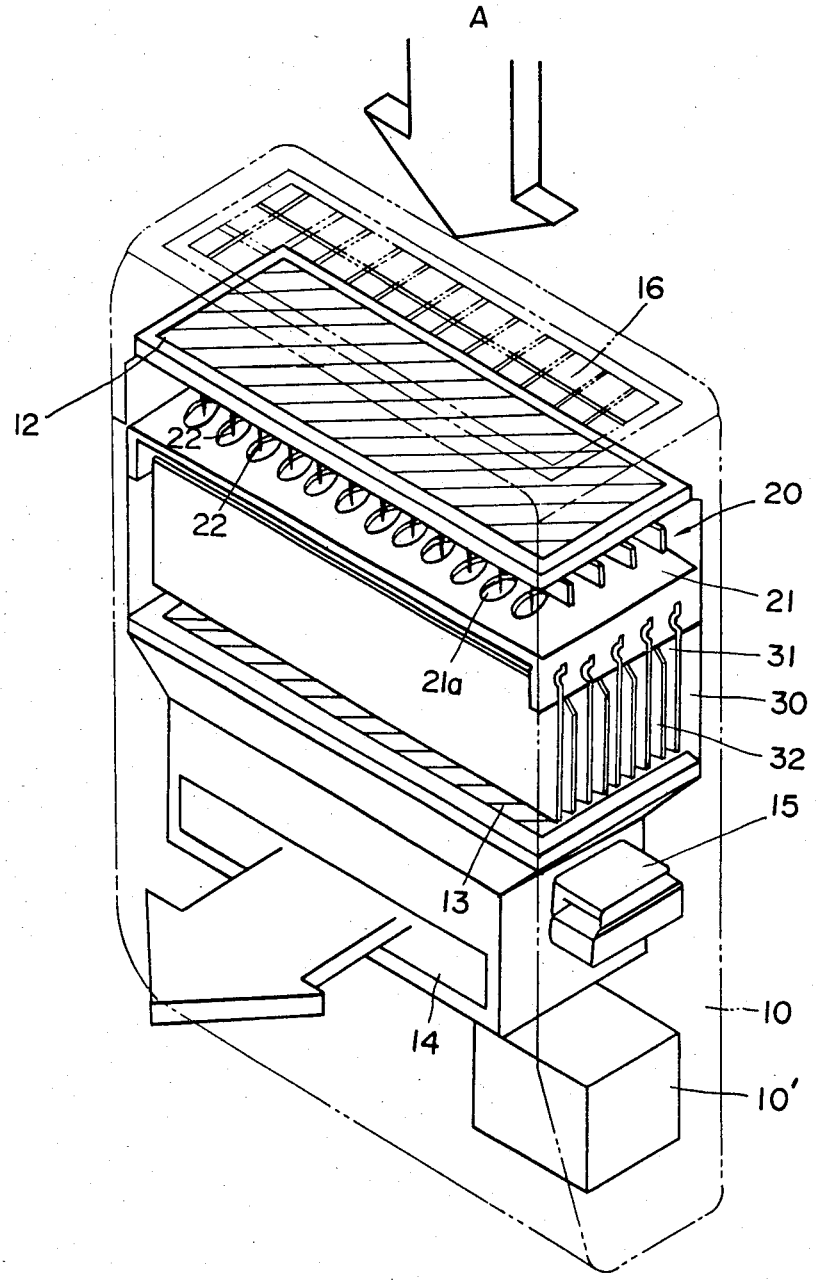
FIG. 6 is a perspective view showing one embodiment of the present invention.

Incidentally, reference numeral 10' appearing in FIG. 6 indicates a high power supply box in which the aforementioned power supply 23 is built to improve the corona discharge.

The assembly of the air cleaner thus constructed is made by inserting the coupling discharge electrode 21 and the discharge plates 24 from one side of the body of the dust collecting unit 11' and holding them in the aforementioned positional relationship, by inserting the dust-collecting coupling electrodes 32 and the dust collecting electrodes 31 from the other side in parallel with one another by making use of the aforementioned guides 11'', and by fitting both the end portions of the dust collecting electrodes 31 in the aforementioned mounting grooves 27 of the coupling discharge electrode 21, thus constructing the dust collecting unit 11'. Incidentally, reference numeral 11''' indicates a bail which is used to take in and out said unit. The dust collecting unit 11' thus constructed is mounted together with the pre-filter 12 and the deodorizing filter 13 in the casing 10.

As has been described hereinbefore, according to the present invention, the coupling discharge electrode is made of the metal plate having the numerous circular holes, and the dischare electrodes have their leading ends positioned at the centres of the respective circular holes to eliminate the charging irregularities. Since the velocity of the air flow through the circular holes is high without any charging irregularity, moreover, the circular holes are reluctant to get clogged by the dust, and the bad smells such as cigarette smoke or ammonium gas can be filtered out together with the dust by the action of the deodorizing filter. Furthermore, the discharge electrodes can be easily assembled and positioned at the centres of those circular holes.

Furthermore, the discharge electrodes and the coupling discharge electrode can be worked by the single pressing operation so that they can be molded with ease and at a reasonable cost.

According to the present invention, furthermore, the dust collecting electrodes can be mounted and demounted with each so that their replacing works can be facilitated, and they are reluctant to come out once they are attached to the coupling discharge electrode so that the air cleaner is not troubled even if its casing is floated while it is being transported or installed. In case the dust collecting electrodes are formed by laminating the aluminum foils on the paper base plate or by coating the paper base plate with the carbon, they can be fabricated with ease and at a reasonable cost and can be disposed of so that they need not be washed to have their maintenance simplified.

What is claimed is:

1. In an air cleaner defining an elongated air passage and having a discharge electrode and a coupling discharge electrode arranged upstream in said air passage, said coupling electrode being a metal plate extending generally perpendicular to said air passage and having circular apertures therein for the passage of air therethrough, means for applying a high voltage across said electrodes to generate a corona discharge therebetween, and a dust collecting electrodes array arranged downstream in said air passage for collecting the dust which has been charged by said corona discharge, said dust collecting electrode array including a plurality of dust collecting plates arranged in parallel with said flow direction of air, a plurality of dust coupling electrode plates arranged in parallel between said dust collecting electrodes and means for applying an electrical voltage thereacross of a polarity different from said corona-generating voltage, the improvement wherein said discharge electrode includes a plurality of sharp points arranged at the respective centers of said circular apertures of said coupling electrode and at least one generally rigid metal flat discharge plate made integral with said sharp points and extending across said air passage, said member carrying flat surfaces running parallel with the flow direction of air in said passage, said sharp points projecting from one side of said plate toward said coupling electrode plate with said points terminating generally in the plane thereof.

2. An air cleaner according to claim 1, wherein said coupling discharge electrode has a thickness of 0.5 to 5 mm.

3. An air cleaner according to claim 1, wherein said coupling discharge electrode is made of an aluminum alloy, copper or stainless steel.

4. An air cleaner according to claim 1, wherein the circular apertures of said coupling discharge electrode have a diameter of 20 to 40 mm.

5. An air cleaner according to claim 1, wherein said discharge electrode is made of a conductive plate of stainless steel or ordinary steel.

6. An air cleaner according to claim 1, wherein said discharge plate is formed at both its end portions with holding raised tongues to be connected with a power supply connector.

7. An air cleaner according to claim 1, wherein said discharge plate has reinforcing ribs extending in the longitudinal direction thereof.

8. An air cleaner according to claim 1, wherein said discharge plate has its one side fused to a reinforcing plate which extends in the longitudinal direction thereof.

9. An air cleaner according to claim 1, wherein said dust collecting electrodes is formed by laminating aluminum foils on both the sides of a paper base or coating the same with carbon.

10. An air cleaner according to claim 1, wherein said discharge electrode has a thickness of 0.1 to 1.0 mm.

11. An air cleaner according to claim 10, wherein the thickness of said discharge electrode is 0.2 to 0.5 mm.

12. An air cleaner according to claim 1, including a deodorizing filter disposed downstream of said dust-collecting coupling electrodes.

13. An air cleaner according to claim 12, wherein said deodorizing filter is made of a material selected from at least one of the group consisting of activated charcoal and an adsorbent of divalent iron ions.

14. An air cleaner according to claim 1, wherein said coupling discharge electrode includes: edges bent from both the end portions thereof downstream of said air passage; and a plurality of mounting grooves formed in said bent edge and extending generally in parallel with each other for removably fitting therein both the end portions of said dust-collecting electrode.

15. An air cleaner according to claim 14, wherein said mounting grooves are sinuously curved at their central portions in order to bite into both the end portions of said dust collecting electrode to hold the same.

* * * * *